US005095585A

United States Patent [19]

Grimshaw et al.

[11] Patent Number: 5,095,585

[45] Date of Patent: Mar. 17, 1992

[54] METHOD AND APPARATUS FOR SECURING CARD-CLOTHING TO FLATS

[75] Inventors: Keith Grimshaw, Todmorden; Brian J. Ennis, Sowerby Bridge, both of England

[73] Assignee: Carclo Engineering Group plc, West Yorkshire, England

[21] Appl. No.: 535,882

[22] Filed: Jun. 11, 1990

[30] Foreign Application Priority Data

Jun. 14, 1989 [GB] United Kingdom ..... 8913668

[51] Int. Cl.[5] ..... D01G 15/24

[52] U.S. Cl. ..... 19/113

[58] Field of Search ..... 19/113, 114

[56] References Cited

U.S. PATENT DOCUMENTS

| | | | |
|---|---|---|---|
| 565,554 | 8/1896 | Mills | 19/113 |
| 581,751 | 5/1897 | Mills | 19/114 |
| 1,709,038 | 3/1928 | Platt | 19/114 |
| 2,097,254 | 11/1935 | Platt | 19/113 |
| 2,562,998 | 8/1951 | Banfield, Jr. | 19/113 |
| 3,151,362 | 10/1964 | Freitag | 19/114 |
| 4,221,023 | 9/1980 | Henderson et al. | 19/113 |
| 4,295,248 | 10/1981 | Beneke et al. | 19/113 |

FOREIGN PATENT DOCUMENTS

| | | | |
|---|---|---|---|
| 1530455 | 12/1966 | France | 19/113 |
| 2612 | of 1876 | United Kingdom | 19/113 |
| 952 | of 1888 | United Kingdom | 19/113 |
| 11924 | of 1894 | United Kingdom | 19/113 |
| 666185 | 2/1952 | United Kingdom | 19/113 |

*Primary Examiner*—Werner H. Schroeder
*Assistant Examiner*—John J. Calvert
*Attorney, Agent, or Firm*—W. Thad Adams, III

[57] ABSTRACT

A method and apparatus for securing card-clothed tops to the flats of revolving flat-type carding machines is disclosed, which obviates the necessity for specialist machines used for securing clipped tops to the flanges of the flats. A special type of top clip is provided which, besides being preformed to engage with the bottom side of the top as is usual, also has an inward hooked formation along its upper longitudinal edge. In addition, various kinds of tensioning elements are provided, each of which is engagable with the hooked formations on the clips, and is resiliently loaded, so that in the assembled condition, it causes the clips to pull the top tightly into engagement with the flanges of the flat.

12 Claims, 3 Drawing Sheets

METHOD AND APPARATUS FOR SECURING CARD-CLOTHING TO FLATS

Figure 1:
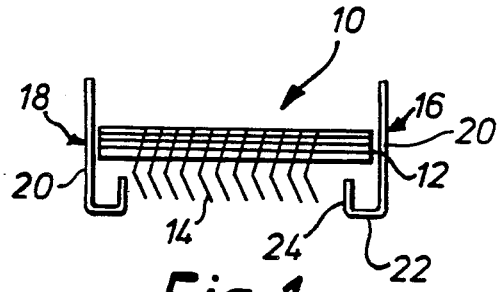

The traditional cast iron flat for use on a revolving flat-type carding machine carries a strip of card-clothing (known as the "top") which, in use, performs the carding action in cooperation with the card-clothing on the cylinder of the machine. Between 80 and 120 flats may be provided on a typical carding machine and the flats of the set are linked together by a continuous chain at each side of the machine. Each cast iron flat is T-shaped and comprises a vertical web and a horizontal upper flange.

At the present time, the "top" is secured to the main face of the flange by means of steel clips, which, when completely fitted, each embrace a longitudinal edge of the "top" foundation and the corresponding longitudinal edge of the flat flange. As manufactured, each clip comprises a steel strip which has a flat spine from the bottom edge of which there projects inwardly a narrow flange and an upturned lip is provided on this flange. Teeth or serrations are formed in the lip for engagement in the foundation of the "top". There is however no deformation of the spine at its upper edge.

A two stage process is used to secure the top to the flat. In the first stage, the two clips are clinched into the "top" foundation, using a specialised machine, and this is done during manufacture of the "top". A "top" with the two clips thus attached to it is referred to as a clipped "top", and at this stage, the two clip spines abut the respective longitudinal edges of the foundation and project above those edges.

In the second stage, the clipped "top" is first laid on the main (under) surface of the flat flange—in this condition the spines of the two clips abut the respective longitudinal edges of the flat flange and project above the flange. Then the upwardly projecting parts of the two spines are bent over the marginal portions of the flat flange and pressed downwardly into engagement with the topside of the flat flange. This bending operation to secure the "top" to the cast iron flat requires the use of a specialised machine which precisely locates the "top" on the flat and then bends the clips around the upper edges of the flat flange.

The second "top" securing stage is usually carried out by a local flat clothing workshop or by the spinning mill where the carding machines are located. In any event, a specialised "top" securing machine has to be employed each time the flats are reclothed, which typically may be every two to four years depending upon the working conditions of the carding machine. In the case of a geographically isolated spinning mill, this method of reclothing the flats is very expensive, because it involves either sending the set of flats, weighing perhaps 500 kilograms to the nearest flat clothing workshop, which may be a great distance from the mill, or equipping the mill itself with the specialised flat clothing machinery and having personnel trained to use that machinery.

It is an object of the invention to provide a method of securing card-clothing "tops" to carding machine flats, which overcomes this problem by avoiding the necessity to utilise specialised flat clothing machinery. It is a further object of the invention to provide a method of securing card-clothing "tops" to the carding machine flats which will allow the "tops" to be readily removed and changed without the use of special machinery.

According to a first aspect of the invention, in a method of securing a card-clothed "top" to a carding machine flat, there is employed a clip which engages with both the top and the flat flanges (or another element associated with the flat), the clip having a first inward formation which engages with the card-clothed face of the "top" and a second, preformed inward formation, which engages with the flanges or the said other element, a tensioning device engaging between the second inturned formation on the clip and the flat flanges and exerting a force in the direction to press the first inward formation towards the main face of the flat flanges, the preforming of the second inward formation ensuring that the securing of the "top" to the flat can be achieved without bending of the clip to produce the second formation after the "top" has been offered up to the flat.

According to a preferred feature of this aspect of the invention, the tensioning device is strained to permit the second inward formation to be fitted over the flanges of the flat, but the strain is partially released after the clip has been fitted, so that the tensioning device then exerts a force holding the clip in position and the unreleased strain in the tensioning device provides the force pressing the first inward formation towards the main face of the flat flanges.

Preferably, the second inward formation on the clip is returned towards the flanges of the flat, and the tensioning device has a flange which has a return in the opposite sense to that of the second inward formation, so that the two returns hook on to each other.

It is further preferred, that the tensioning device is resiliently loaded.

According to a second aspect of the invention, a clip for securing a card-clothing "top" to the main surface of a carding machine flat comprises a median spine portion; a first inward formation from the median portion for engagement with the card-clothed face of the "top" and a preformed second inward formation from the median portion for location over a flange of the flat and for engagement with a tensioning device, so that the clip requires no bending to produce the second inturned formation after application of the clip to the "top" and to the flat. Preferably the first inward formation is also preformed. It is further preferred that the second inward formation is returned to form an acute angle with the median portion. It is still further preferred that the first inward formation is formed with teeth along its edge for engagement in the foundation of flexible foundation type card-clothing "top".

According to a third aspect of the invention a flat for a carding machine has a card-clothed "top" applied to the main surface of the flat flanges and clips securing the "top" to the flanges, each clip engaging with the "top" and having a preformed inward formation on the upperside of the flat flange, there being tensioning means engaging between the flat and the preformed inward formation and applying a force to the clip through the inward formation in a direction to cause the clip to pull the "top" towards the flat flange.

In one arrangement, the tensioning device comprises a tensioning plate having a lip engaging with the preformed inward formation of the clip, the plate being fulcrumed on the upperside of the flat flange so that turning of the plate on its fulcrum in a loading direction provides the force to cause the clip to pull the "top" towards the flat flange, there being means to retain the plate in a force-applying position. Preferably, there is a clip and tensioning plate at each side of the flat and a releasable bridging clip is provided which connects the two plates and secures them together in force-applying positions. Alternatively, there may be a clip and tensioning plate at each side of the flat, the plates being adapted for inter-engagement in force-applying positions. For instance, the tensioning plates may be formed with a ratchet-type interconnection for holding them in the force-applying positions and one or both plates may be resiliently loaded towards the ratchet engaged position, so that the ratchet can be released by stressing the resilient loading. In one method of achieving this, a resilient element is provided acting between the tensioning plate and the preformed inward formation on the clip.

In another method of carrying out this aspect of the invention, a clip is provided on each side of the "top" and the tensioning means comprises a channel-shaped tension element, the web of the flat being accommodated in the channel, there being lips on the flanges of the channel having hooked engagement with the inward formations on the two clips, there also being resilient loading means urging the channel element away from the topside of the flat flanges to apply the force required to cause the clips to pull the "top" towards the flat flanges.

In one construction, a convoluted spring acts between each lip of the channel element and the topside of the flat flanges to provide the tensioning force. In an alternative arrangement, a convoluted spring acts between the end of the flat web and the web of the channel element to provide the tensioning force.

Several methods of securing card-clothed "tops" to cast iron flats for use in carding machines will now be described by way of examples only, with reference to the, accompanying drawings, in which:

PRIOR ART

Figure 2:
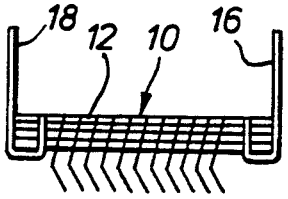
Figure 3:
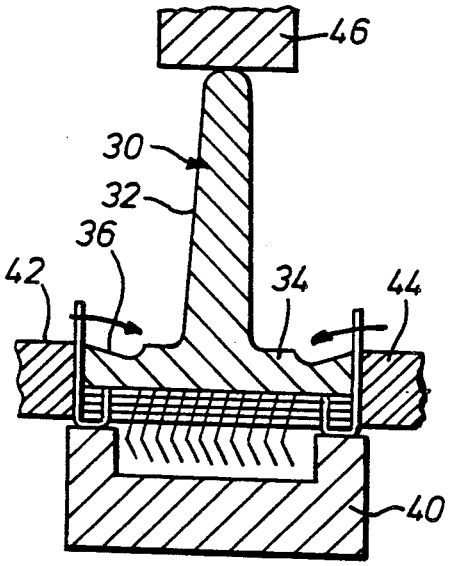
Figure 4:
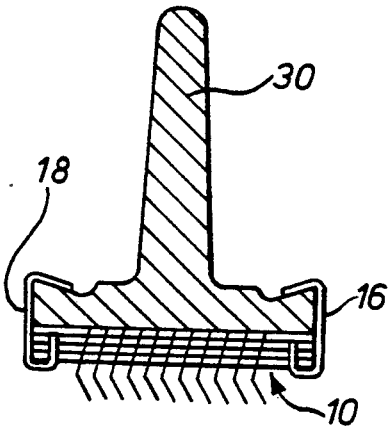
Figure 5:
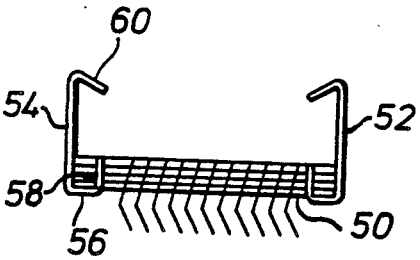
Figure 6:
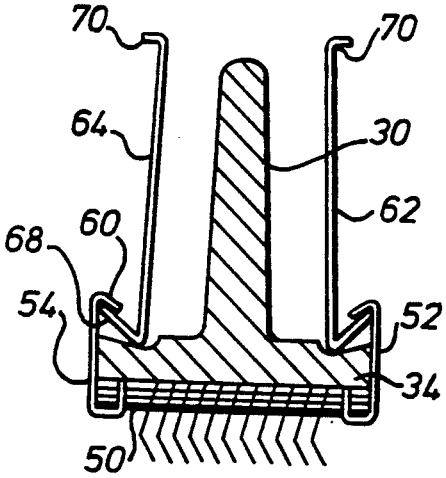
Figure 7:
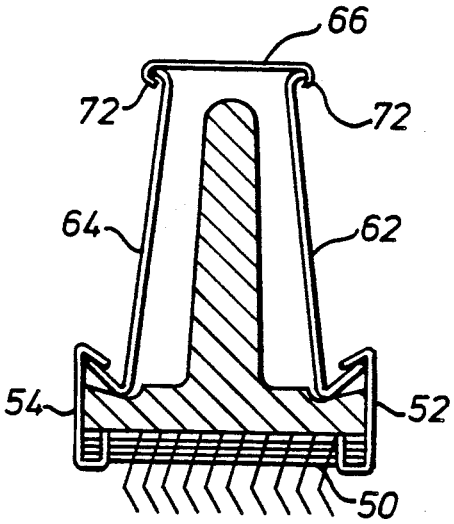
Figure 8:
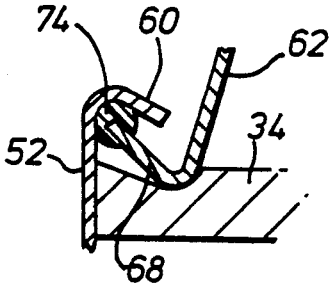
Figure 9:
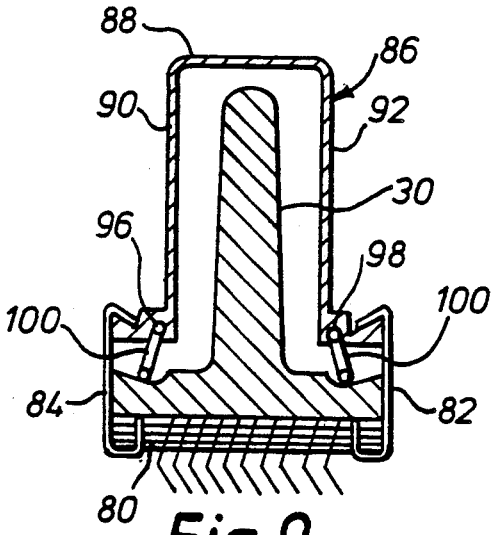
Figure 10:
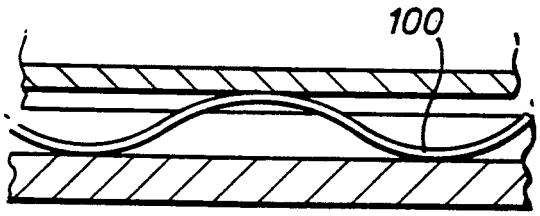
Figure 12:
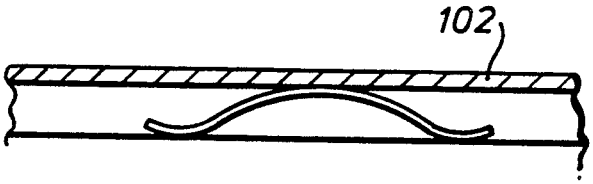
Figure 11:
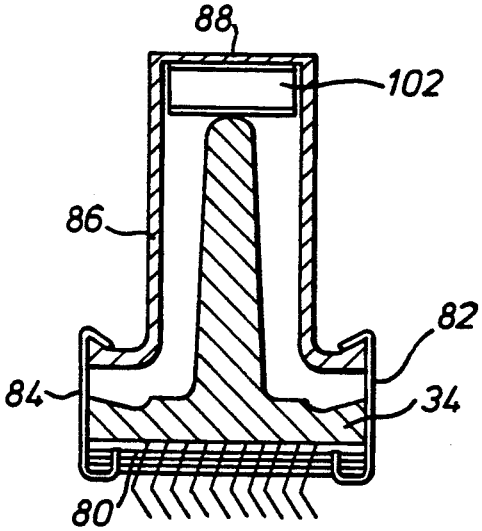
Figure 13:
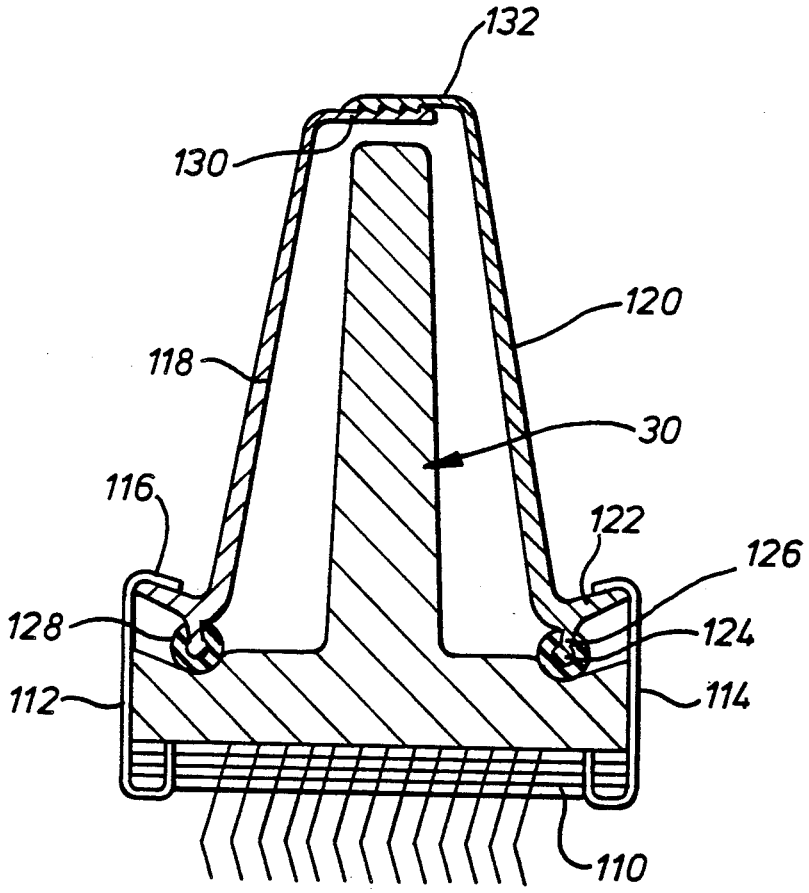

FIG. 1 is a transverse section through a card-clothing "top" showing a pair of conventional clips, FIG. 2 is a view similar to FIG. 1, showing the clips fitted to the "top", FIG. 3 is a diagrammatic transverse section through a carding machine flat in a special machine of the type presently used for fitting "tops" to the flats, FIG. 4 is a view similar to FIG. 3, but showing only the flat after the "top" has been fitted by the present method, FIG. 5 is a view similar to FIG. 2, but showing a "top" fitted with clips in accordance with the invention, FIG. 6 is a transverse section through a flat showing the fitting of a "top, of the kind shown in FIG. 5, FIG. 7 is a view similar to FIG. 6, but showing the flat with the "top" fitted, FIG. 8 is a detail view showing a possible modification of the method of FIGS. 5, 6 and 7, FIG. 9 is a view similar to FIG. 7, but showing an alternative method of securing a "top" to a flat, FIG. 10 is a detail longitudinal section through the flat shown in FIG. 9, FIG. 11 is a view similar to FIG. 7, showing another method of securing a "top" to a flat, FIG. 12 is a detail longitudinal section through the flat shown in FIG. 11, and FIG. 13 is a view similar to FIG. 7, showing yet another method of securing a "top" to a flat.

The methods in accordance with the invention will be better understood by first considering the present method of securing card-clothed "tops" to carding machine flats, which is illustrated in FIGS. 1 to 4. A typical card-clothing "top" 10 comprises a flexible foundation 12 of laminated material (e.g. fabrics, rubberised fabrics and plastics sheets) in which are embedded card-clothing wires 14, which are punched through the foundation from the upperside (or crownside), the wires being formed as staples so that each provides two wire teeth on the upper side of the foundation, the crown of each staple remaining on the upperside of the foundation. The "top" itself is striplike and is long enough to extend across the full width of the cylinder of the carding machine. Flexible foundation type card-clothing "tops" for flats are well known and need no further description.

For the purpose of securing the card-clothing "top" 10 to a flat of a carding machine, a pair of steel clips 16 and 18 is provided. Each of these clips comprises a strip of approximately the same length as the "top", the strip comprising a flat median or spine portion 20, an inturned flange 22 along the bottom edge of the spine portion 20, and a depending lip 24 along the inner edge of the flange 22. Each of the lips 24 is formed with a series of teeth or serrations, which are able to bite into the flexible foundation 12 of the "top" 10. The flanges 22 with their lips 24 are preformed on the spine 20, before the clips 16 and 18 are fitted to the "top" 10, and for present purposes, the flanges 22 are referred as "inward formations" since they are bent inwardly from the spine portions 20 of the clips.

In a primary stage of fitting a "top" to a flat, which is illustrated in FIG. 2, each of the clips is engaged with the "top" 10 by pressing the toothed lips 24 into the foundation 12, until the inward formations or flanges 22 engage with the under surface of the foundation. The spine portions 20 of the clips 16 and 18 abut with the longitudinal edges of the foundation 12, and these spine portions project above the foundation 12 as illustrated in FIG. 2. This referred to as a clipped "top" and the clipped "top" may be produced as part of the manufacture of the top itself. In other words, the fitting of the clips 16 and 18 may be carried out at the works where the "top" is manufactured, and then the clipped "top" is supplied to the mill or the flat clothing works.

At the mill or flat clothing works, there is a specialised "top" clipping machine, parts of which are shown in FIG. 3. In that figure, a cast iron carding machine flat 30 is illustrated ready to be fitted with a "top" 10. The flat itself is of conventional construction, and it need only be mentioned here, that it essentially comprises a web 32 and two flanges 34, which together form the characteristic T-shaped cross-section, although in the flat illustrated in FIG. 3, the undersides of the flange 34 are raked downwardly as indicated at 36.

In the "top" clipping machine, there is an anvil 40 on which the marginal portions of the "top" rest, and a pair of side clamps 42 and 44 which are able to move towards and away from each other in a horizontal direction. With the side clamps 42 and 44 in an open condition, the clipped "top" 10 is placed under the main surface of the flange 34 of the cast iron flat 30, and the upstanding parts of the spines 20 of the two clips 16 and 18 engage with the longitudinal edges of the flange 34 as illustrated in FIG. 3, and therefore serve to locate the "top" on the flange 34. A top clamp 46 which is movable vertically relatively to the anvil 40, is in a raised position clear of the flat 30 when the clipped "top" is placed in position on the flat, but once the "top" has been located on the flat, this top clamp 46 is lowered into a flat web engaging position illustrated in FIG. 3 where it forms a second anvil.

Finally, the machine is equipped with folders (not shown) which move into engagement with the parts of the spines 20 of the clips projecting above the flanges 34, and bend these depending portions of the spines inwardly and downwardly as indicated by the arrows in FIG. 3, eventually pressing the thus inturned parts of the spine portions 20 of the clips into tight engagement with the raked uppersides 36 of the flanges 34. The final position is illustrated in FIG. 4, where each of the clips 16 and 18 tightly embraces both the "top" 10 and a flange 34 of the flat, thereby clamping the "top" on to the flanges of the flat. Once this condition is arrived at, the clamps 42, 44 and 46 can be opened, to allow the flat now equipped with its "top" to be removed from the machine ready for use on the carding machine.

It will be appreciated, that in order to remove a worn "top" from a flat when it has been fitted by the present method illustrated in FIG. 1 to 4, it is first necessary to prise the inturned upper portions of the clips 16 and 18 away from the raked uppersides of the flanges 34, to enable the clips 16 and 18 to be disengaged from the flat.

Turning now to FIGS. 5, 6 and 7, there is illustrated a first method of securing a "top" to a flat in accordance with the invention. A "top" 50 is itself of conventional construction, and needs no further explanation. This "top" is fitted with preformed clips 52 and 54, and this operation may be carried out at the works where the "top" is manufactured in order to provide a clipped "top". However, it will be noted, that whereas the conventional clips 16 and 18 illustrated in FIG. 1 comprise a flat spine 20 with the inturned flange 22 and lip 24, the clips 52 and 54 each have a flat spine and the preformed flange 56 and toothed lip 58 along the bottom edge of the spine, but there is also a preformed second inward formation or upper flange 60 bent from the top edge of the spine of the clip. As illustrated in FIG. 5, each of the upper flanges 60 is angled downwardly, to form an acute angle with the spine of the clip. Moreover, the depth of the spine of each of the clips 52 and 54 is such that when the "top" 50 is laid on the flanges 34 of the flat 30 (see FIG. 6) the upper flanges 60 of the clips 52 and 54 are spaced some distance above the raked topsides of the flanges 34.

The fitting of this clipped "top" 50 to a flat 30 which is illustrated in FIG. 6 and 7, can be carried out at the mill where the flats are required to be used on a carding machine, without the use of any specialised "top" fitting machinery.

In addition to the flats 30 and the corresponding number of clipped "tops" 50, for the purposes of the "top" fitting method of the invention, there are also provided two tensioning plates 62 and 64, and a bridging lip 66 (see FIGS. 6 and 7). Each of the tensioning plates 62 and 64 is made of sheet steel, and in this particular arrangement, each of these plates is of approximately the same length as the "top" although it would be possible to use a plurality of relatively short tensioning plates arranged along each side of the flat 30.

As shown in FIGS. 6 and 7, each tensioning plate has a main flat spine which is somewhat greater in depth than the depth of the web 32 of the flat, an out-turned and upwardly angled hooking flange 68 along its bottom edge and an out-turned narrow lip 70 along its top edge. The bridging clip 66 comprises a flat steel plate again of the same length as the "top" formed with downturned hooked lips 72 on its longitudinal edges.

In order to assemble the "top" on the flat, the "top" 50 is first placed on the main surface of the flanges 34 of the flat, with the spine portions of the clips 52 and 54 in abutting engagement with the longitudinal edges of the flanges. In order to place the "top" in this position, it is necessary either to slide the "top" along the length of the flat, or alternatively, to distend the clips 52 and 54 away from each other, to allow their hooked upper flanges 60 to pass to the upperside of the flanges 34. With the "top" thus located on the main surface of the flat, each of the tension plates 62 and 64 is fitted to a respective side of the flat, by hooking the hooked flange 68 over the respective hooked flange 60 on the corresponding clip. The acute angling of the two flanges 60 and 68 with respect to the spines of the clip and tension plate assist in the inter-engagement of the two hooked flanges. At this stage, the angled corner between the spine and hooked flange of each tension plate will rest on the raked upper surface of the respective flange 34 of the flat, and this provides a fulcrum for the tension plate, but the upper ends of the tension plates will be quite widely spaced apart as illustrated in FIG. 6.

The tension plates 62 and 64 are then flexed towards each other to allow the hooks 72 on the bridging clip 66 to be engaged with the lips 70 at the upper edges of the tensioning plates 62 and 64 as illustrated in FIG. 7. This can be achieved by drawing the upper ends of the tension plates 62 and 64 close enough together to allow their lips 70 to engage under the hooks 72. Now the effect of this drawing together of the upper ends of the tensioning plates 62 and 64 is to cause those plates to tend to turn about their fulcrums on the flanges 34, and in each case, this has the effect of transmitting an upward force through the hooked flange 68 to the hook 60 of the respective clip 52 or 54, which in turn causes that clip to pull the "top" into tight engagement with the main surface of the flat 34. Once the bridging clip 66 has been engaged with the upper longitudinal edges of the tensioning plates 62 and 64, those plates can be released, because the bridging clip will hold them in the position illustrated in FIG. 7. This keeps the arrangement under tension, and causes the tensioning plates 62 and 64 to hold the "top" 50 firmly in engagement with the flat 34. The card-clothed flat is then ready for use. The fact that the web 32 of the flat 30 is entirely housed within the assembly comprising the tensioning plates 62 and 64 and the bridging clip 66 is of no concern, since this web takes no part in the driving of the flats on the carding machine, but is simply provided for strengthening purposes.

It will be appreciated, that the entire "top" fitting operation which has just been described with reference to FIGS. 5, 6 and 7 of the drawings can be carried out manually, and once the operative has acquired a certain amount of dexterity, can be done quite quickly. When it is necessary to remove the "top" from the flat, it is only necessary to reverse the fitting steps, beginning by drawing the upper ends of the tensioning plates 62 and 64 towards each other to allow the bridging clip 66 to be disengaged.

Referring to FIG. 8, there is illustrated one longitudinal edge portion of the flange 34, part of the clip 52, with its hooked flange 60, and part of the tensioning plate 68 with its hooked flange 66. The construction is as previously described, excepting that the hooked flange 68 on the tensioning plate 62 is fitted with a rubber or rubber-like plastics moulding 74, which engages in the angle between the spine and the hooked flange of the clip 52. Such a moulding accommodates any slight variations in the thickness of the flanges 34 of the flat. Alternatively, a rubber or rubber-like plastics strip could be fitted between the tensioning plate 62 and the upper surface of the flange 34 of the flat i.e. at the fulcrum to accommodate variations in the thickness of the flanges.

An alternative method of securing a card-clothed "top" 80 to a flat 30 of a carding machine is illustrated in FIGS. 9 and 10. Again, this "top" 80 is fitted with preformed clips 82 and 84 of the kind described with reference to FIG. 5. However, in this arrangement, instead of the two tensioning plates, there is a deep channel shaped tensioning member 86, which is of unitary construction, and which could be manufactured for example from aluminium by an extrusion process. Besides the web 88 and the flanges 90 and 92, the tensioning element 86 has out turned flanges 94 and 96 along its upper edges. Each of these flanges 94 and 96 is formed with a raked uppersurface, which is a snug fit on the hooked inturned flange 60 of the respective clip 82 or 84 as illustrated in FIG. 9. There is also a groove 98 extending longitudinally of the tensioning element 86 in the main surface of each of the flanges 94 and 96, and a convoluted spring 100 (see also FIG. 10) that is to say, an undulating strip spring, is received in the groove 98, and engages with the raked upper surface of the flange 34 of the flat. Thus, the undulating spring 100 urges the tensioning element 86 upwardly, and in so doing, causes that element to press on the inturned hooked flanges 60 of the clips 82 and 84, which in turn causes the clips to pull the "top" 80 tightly into engagement with the main surface of the flat 30. The result is that the fitting of the "top" to the flat is completed, and the flat is then ready for use. When it is necessary to remove the "top", from the flat, it is only necessary to press on the web 88 of the tensioning element 86, to move that element downwardly towards the flange 34 of the flat, so as to allow the hooks 60 of the clips 82 and 84 to be disengaged from the flanges 94 and 96 of the tensioning element, thereby allowing the "top" to be removed from the flat.

Turning now to FIGS. 11 and 12, there is illustrated an arrangement which is very similar to that shown in FIGS. 9 and 10, and for that reason, the same reference numerals have been used. However, instead of the undulating springs 100 on each side of the, web 32 of the flat, there is a single undulating spring or series of leaf springs 102 located between the top edge of the web of the flat and the inside face of the web 88 of the tensioning element 86. This spring or series of springs, has exactly the same effect as the undulating springs 100, that is to say it forces the tensioning element 86 away from the flange 34 of the flat, causing the clips 82 and 84 to pull the "top" into secure engagement with the main surface of the flange of the flat.

In FIG. 13 there is illustrated another arrangement for fitting a card-clothing "top" 110 to a flat 30. Again, the clipped "top" is as described with reference to FIG. 5, that is to say, it has clips 112 and 114 each of which has a hooked flange 116 on the top edge. In addition, there are two tensional elements 118 and 120, each of which extends throughout the full length of the "top" and is constituted by an aluminium extrusion. Each of the tensioning elements 118 and 120 has a main spinal portion similar to the spines of the tensioning elements 86, and an out turned hooked flange 122 at its bottom end, for engagement over the hooked inturned flange 116 of the respective clip 112 and 114. Further, there is a longitudinally extending bead 124 joined to the hooked flange 122 by a short stem 126, and a rubber or elastomer moulding 128 of cylindrical external shape is fitted around each bead 124. Each of these mouldings 128 engages in an angle of the upperside of the flat flange, and provides the fulcrum for the tensioning plate 118 or 120.

Along their top edges, each of the tensioning elements 118 and 120 is provided with an inturned flange 130 or 132. The flange 130 is formed with ratchet-type teeth on its topside, and the flange 132 is formed with ratchet-type teeth on its underside. Furthermore, these ratchet-type teeth are inter-engagable, as illustrated in FIG. 13. However, in order to engage the ratchet teeth of the two flanges 130 and 132 with each other, it is necessary to draw the top parts of the tensioning elements 118 and 120 towards each other, and this has the effect of turning those tensioning elements on their fulcrums, producing the force required to hold the "top" 110 securely on the flat 30. Consequently, once the tensioning elements 118 and 120 have been drawn towards each other and their ratchet teeth engaged with each other, the assembly of the "top", on the flat is completed, and the ratchet teeth arrangement replaces the bridging clip 66 shown in FIG. 7. The necessary resilience is obtained from the elastomeric mouldings 128. If it is required to increase the tension applied to the clips 112 and 114, this can be achieved by drawing the upper ends of the tensioning elements 118 and 120 further towards each other, to allow the ratchet teeth to engage in an alternative position. In order to release the "top" from the flat, it is necessary to squeeze the upper ends of the tensioning elements 118 and 120 towards each other a sufficient distance to permit the ratchet teeth to become disengaged.

In each of the examples illustrated by reference to the accompanying drawings, the "top" is made of flexible foundation type card-clothing. It is to be understood however, that the invention could be employed with a "top" made as an assembly of short strips of metallic wire-type card-clothing held together by a spine or casing. With metallic wire-type "top" the lips 58 on the clips need not be serrated, because in any event, they could not penetrate the casing of the "top". Indeed, these lips may be omitted altogether, though it might be desirable to roughen the topsides of the flanges 56 of the clips.

We claim:

1. A method of securing a card clothing top to a carding machine flat, said flat having flanges comprising the steps of: engaging a clip with both said top and said flat flanges, said clip having a first preformed inward formation engageable with the card clothing top and a second preformed inward formation engageable with a resilient tensioning device between said second inward formation on said clip and the flat flanges, wherein said tensioning device exerts a force in a direction to press said first inward formation towards a main surface of said flat flanges, whereby the preforming of said second inward formation ensures that said top is secured to said flat without bending said clip to produce said second formation after said top has been offered up to said flat.

2. A method of securing a top to a carding machine flat according to claim 1, wherein said tensioning device is strained to permit said second inward formation to be fitted over said flanges of said flat, and said strain is partially released after said clip has been fitted, whereby said tensioning device exerts a force for holding said clip in position and the unreleased strain in said tensioning device provides a force for pressing said first inward formation towards said main face of said flat flanges.

3. A method of securing a top to a carding machine flat according to claim 2, wherein said second inward formation on said clip is returned towards said flanges of the flat and said tensioning device has a flange which has a return in a sense opposite to that of said second inward formation, so that the two returns hook on to each other.

4. A clip for securing a card-clothing top to a carding machine flat, comprising: a median spine portion; a fist inward formation from said median portion adapted for engagement with the card-clothed face of the top and a preformed second inward formation from said median portion adapted for location over a flange of said flat and further adapted for engagement with a tensioning device, wherein said clip requires no bending to produce the second inward inturned formation after application of said clip to said top and to said flat.

5. A clip according to claim 4, wherein said second inward formation is returned to form an acute angle with said median portion.

6. A clip according to claim 4, wherein said first inward formation is formed with teeth along its edge for engagement in the foundation of a flexible foundation-type card-clothing top.

7. In a carding machine, a flat having a flange and a main surface formed on said flange, a card-clothed top for application to said main surface of the flat flanges and clips for securing said top to said flanges, wherein each clip engages with a top and has a preformed inward formation, tensioning means engages between said flat and said preformed inward formation to apply a force to said clip through said inward formation, in a direction to cause said clip to pull said top towards the flat flanges.

8. A flat according to claim 7, wherein said tensioning device comprises a tensioning plate having lip engageable with said preformed inward formation of said top, said tensioning plate being upper sidewardly fulcrumed about said flat flange, wherein turning said plate about said fulcrum in a loading direction forces said clip to pull the top towards said flat flanges and means for retaining said plate in a force-applying position.

9. A flat according to claim 8, wherein a clip and tensioning plate is provided at each side of the flat and a releasable bridging clip is provided which connects the two plates and secures them together in force-applying positions.

10. A flat according to claim 8, wherein a clip and tensioning plate is provided at each side of the flat and said plates are adapted for inter-engagement in force-applying positions.

11. A flat for a carding machine according to claim 10, wherein said tensioning plates are formed with a ratchet-type interconnection for holding them in force-applying positions and at least one of said plates is resiliently loaded towards a rachet-engaged position so that said ratchet is releasable by releasable by stressing the resilient loading.

12. A flat according to claim 7, having a web extending from said flange, wherein a clip is provided on each side of said top said tensioning means comprises a channel-shaped tensioning element, said web is accommodated in said channel, and resilient loading means for urging the channel-shaped element away from the flat flanges to apply a force required to cause said clips to pull said top towards said flat flanges.

* * * * *